United States Patent [19]

Laar

[11] 4,104,668

[45] Aug. 1, 1978

[54] CONTINUOUS PROCESSOR FOR PHOTOGRAPHIC FILMS OR THE LIKE

[75] Inventor: Erwin Laar, Taufkirchen, Fed. Rep. of Germany

[73] Assignee: AGFA-Gevaert, AG, Leverkusen, Fed. Rep. of Germany

[21] Appl. No.: 783,800

[22] Filed: Apr. 1, 1977

[30] Foreign Application Priority Data

Apr. 15, 1976 [DE] Fed. Rep. of Germany ..... 2616869

[51] Int. Cl.[2] ..... G03D 13/00

[52] U.S. Cl. ..... 354/299; 354/324; 219/321; 219/328

[58] Field of Search ..... 354/297, 299, 323, 324; 137/341; 219/320, 321, 328, 388

[56] References Cited

U.S. PATENT DOCUMENTS

| | | | |
|---|---|---|---|
| 2,570,627 | 10/1951 | Albin | 354/299 |
| 3,337,714 | 8/1967 | Buechner | 219/321 |
| 3,832,730 | 8/1974 | Geyken et al. | 354/299 |
| 3,978,506 | 8/1976 | Geyken et al. | 354/324 |

*Primary Examiner*—L. T. Hix
*Assistant Examiner*—Alan Mathews
*Attorney, Agent, or Firm*—Peter K. Kontler

[57] ABSTRACT

A continuous developing machine for exposed photographic material has a vessel with one or more outlets close to its bottom and one or more inlets at its top, conduits which connect the outlets with the inlets, a pump which circulates the developing solution from the outlets to the inlets, and a heating device which is installed in the conduits downstream of the pump and has a primary heater which is activated with a first delay whenever the temperature of developed solution downstream of the heating device drops below and is deactivated with a second delay whenever the temperature of developing solution rises above a preselected value, and an adjustable auxiliary heater which is actuated during each interval of admission of a liquid replenisher into the conduits upstream of the pump. The auxiliary heater is adjusted in dependency on changes in temperature and/or rate of admission of the replenisher. The temperature of the mixture of developing solution and replenisher is monitored immediately downstream of the heating device for the purpose of activating or deactivating the primary heater. A heat exchanger preheats the replenisher prior to admission into the conduits upstream of the pump.

10 Claims, 5 Drawing Figures

CONTINUOUS PROCESSOR FOR PHOTOGRAPHIC FILMS OR THE LIKE

BACKGROUND OF THE INVENTION

The present invention relates to processors in general, especially to continuous developing machines for exposed photographic paper or the like, and more particularly to improvements in developing machines wherein at least one of a battery of tanks for storage of liquid baths receives a liquid replenisher at regular or irregular intervals.

The quality of exposed photographic paper or films is affected by variations in temperature of the photochemical developing bath or baths. It is desirable to insure that the temperature remains constant or fluctuates within an extremely narrow range. Therefore, many presently known developing machines comprise heating devices for some or all of the liquid baths, and means for regulating the heating action of such devices. The regulating means is intended to insure that the temperature of each heated liquid bath will remain within a desired range. A drawback of presently known developing machines is that the temperature of the bath fluctuates within a much wider range if the quantity of material to be processed varies, e.g., when the number of photographic films or photographic paper strips which are transported simultaneously increases or decreases as well as when relatively narrow strips or webs of photographic film or paper are followed by wider strips or vice versa. Still further, the temperature of a bath will change if the speed at which one or more strips are transported therethrough is changed. Fluctuations of bath temperature under the just outlined circumstances are attributable, to a considerable degree, to the need for addition of replenisher in quantities which vary as a function of the quantity of material passing through a bath per unit of time. The temperature of the replenisher is normally different from the temperature of the bath or from the desired temperature of the bath. Heretofore known attempts to maintain the temperature of the bath close to the desired value include the provision of regulators having mobile pointers which engage or are disengaged from electric contacts at different temperatures and are associated with thermorelays. Such devices are incapable of changing the temperature practically immediately after the temperature begins to deviate from an optimum range. Moreover, the energy requirements of conventional regulating devices are extremely high.

OBJECT AND SUMMARY OF THE INVENTION

An object of the invention is to provide a continuous developing machine or processor for exposed photographic paper or films which maintains the temperature of developing solution at or very close to the optimum value irrespective of fluctuations of the temperature and/or the quantity of intermittently admitted replenisher.

Another object of the invention is to provide the developing machine with novel and improved means for heating the solution which is drawn from and readmitted into one or more tanks of the machine as well as for heating the replenisher prior and subsequent to mixing of the replenisher with the circulating solution.

A further object of the invention is to provide the developing machine with novel and improved control means for the heating device and with novel and improved means for preheating the replenisher prior to mixing with the circulating solution.

An additional object of the invention is to provide a simple, reliable and economical arrangement for maintaining the temperature of developing solution in the tank or tanks of a developing machine at or close to an optimum value.

An ancillary object of the invention is to provide a heating device which can be installed in existing developing machines as a superior substitute for conventional devices which serve to heat the developing solution and replenisher.

The invention is embodied in a developing machine for exposed photosensitive material which comprises a vessel containing a supply of a first liquid (developing solution) and having at least one outlet (preferably close to the bottom) and at least one inlet (preferably close to the top), first conduit means which connects the inlet with the outlet, pump means which is installed in the conduit means to circulate the first liquid in a direction from the outlet toward the inlet, a heating device which is installed in the conduit means downstream of the pump means and includes a primary and a secondary or auxiliary heater, second conduit means which communicates with the first conduit means upstream of the heating device, a metering device or analogous means for admitting to the second conduit means a second liquid (replenisher) at certain (regular or irregular) intervals so that the second liquid is admixed to the first liquid, and control means which includes means for actuating the auxiliary heater during the aforementioned intervals. The arrangement is preferably such that the actuating means automatically starts the auxiliary heater simultaneously with the start of admission of the second liquid and automatically arrests or deactivates the auxiliary heater simultaneously with termination of admission of the second liquid.

The control means further comprises means for monitoring the temperature of the mixture of first and second liquids between the heating device and the inlet, and means for respectively activating and deactivating the primary heater when the temperature of the mixture respectively drops below and rises above a predetermined optimum value. The operation of the control means is preferably such that the primary heater is activated with a first delay following the detection of a drop of temperature below the optimum value and is deactivated with a second delay (which may but need not be identical with the first delay) following the detection of a rise of temperature above the optimum value.

As a rule, the temperature of the second liquid will deviate from the temperature of the first liquid at the outlet of the vessel. Therefore, the auxiliary heater is preferably arranged to furnish a heating action which suffices to heat a quantity of liquid corresponding to the average quantity of admitted second liquid to the temperature of the first liquid.

The novel features which are considered as characteristic of the invention are set forth in particular in the appended claims. The improved developing machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
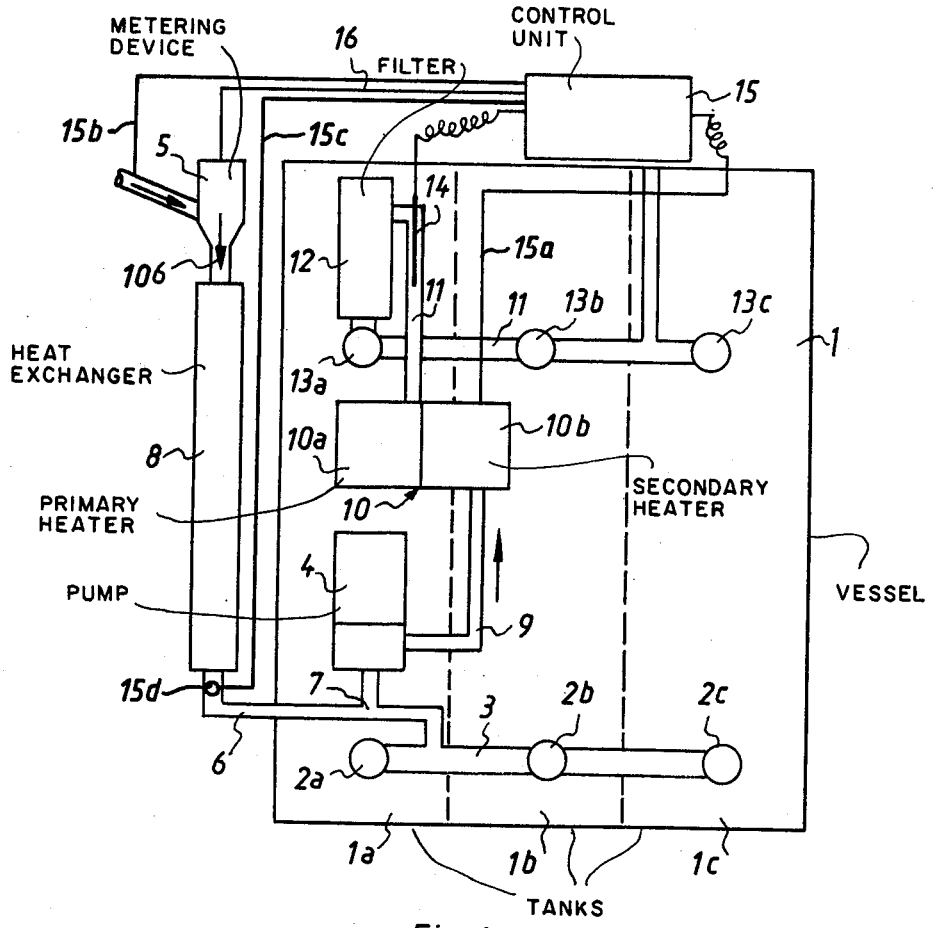
FIG. 1 is a schematic elevational view of a continuous developing machine which embodies the invention.

Referring to FIG. 1, there is shown a continuous developing machine or processor having a vessel 1 which is composed of three tanks 1*a*, 1*b*, 1*c* disposed side-by-side. Each tank contains a liquid bath, and each such bath may but need not consist of a different liquid. The bottom portions of the tanks 1*a*–1*c* are respectively provided with outlets 2*a*, 2*b*, 2*c* which are connected to a common collecting conduit 3. The discharge end of the conduit 3 is connected to the suction intake of a pump 4. The intake of the pump 4 is further connected to a supply conduit 6 which receives preheated replenisher from a heat exchanger 8. The upper end of the heat exchanger 8 receives replenisher from a metering device 5. The direction of admission of replenisher from the metering device 5 into the heat exchanger 8 is indicated by the arrow 106. The heat exchanger 8 may be of the type disclosed in the commonly owned copending application Ser. No. 783,797 of Erwin LAAR et al. filed Apr. 1, 1977 for "Apparatus for conditioning replenishers for developer solutions". The machine preferably comprises a tee 7 which receives liquid from the discharge end of the conduit 3 and from the supply conduit 6 so that the replenisher is mixed with the withdrawn liquid before the resulting mixture enters the pump 4. As a rule, the heat exchanger 8 raises the temperature of replenisher to a level which is below the desired temperature of solution in the vessel 1.

The outlet of the pump 4 is connected with a composite heating device 10 by means of a conduit 9. Heated liquid which issues from the device 10 is conveyed by a conduit 11 which contains a suitable filter 12 and admits heated solution to three inlets 13*a*, 13*b*, 13*c* which communicate with the upper portions of the respective tanks 1*a*–1*c*.

A thermometer 14 monitors the temperature of regenerated solution in the conduit 11 between the heating device 10 and the filter 12. In accordance with a feature of the invention, the heating device 10 includes a primary heater 10*a* and an adjustable secondary or auxiliary heater 10*b*. These heaters are connected to a control unit 15 which includes the thermometer 14 and is connected with the metering device 5 (see the conductor means 16). The thermometer 14 is preferably placed close to the outlet of the heating device 10. The arrangement is such that the control unit 15 automatically starts and arrests the auxiliary heater 10*b* simultaneously with starting and stoppage of the metering device 5. The conductor means 16 transmits a signal whenever the metering device 5 is started or arrested, and such signals are processed by the control unit 15. The operative connection between the control unit 5 and the heaters 10*a*, 10*b* is shown at 15*a*.

The illustrated heating device 10 comprises a receptacle for two electrically heatable coils one of which constitutes the primary heater 10*a* and the other of which constitutes the secondary or auxiliary heater 10*b*. There is no need to divide the interior of the receptacle into two discrete compartments for the respective heaters.

The control unit 15 preferably comprises a movable pointer or contact whose position is a function of the intensity of signals furnished by the thermometer 14. When the monitored temperature exceeds a preselected optimum value, the pointer initiates the generation of a first signal (preferably with a predetermined delay furnished by a suitable thermorelay) which is used to deactivate the primary heater 10*a* via connection 15*a*. A suitable pointer-thermorelay combination which can be used in the control unit 15 is marketed under the designation "Zeigerkontaktregler mit Thermorelais JFC" by the firm Stoerk, Stuttgart-Vaihingen, Federal Republic Germany. When the monitored temperature drops below the optimum value, the pointer causes the generation of a second signal (with a delay which may but need not be identical with the first-mentioned delay). Such second signal is used to start or actuate the primary heater 10*a*. Moreover, the just discussed pointer (or a second pointer) can furnish visible indications of the monitored temperature. The first and second signals can be generated by suitable photocells which are adjacent the path of movement of the first-mentioned pointer.

It will be noted that the heaters 10*a* and 10*b* can be activated and deactivated independently of each other. The primary heater 10*a* is started or arrested in response to signals from the thermometer 14, i.e., in dependency on variations of the temperature of mixture in the conduit 11, and the auxiliary heater 10*b* is on when the metering device 5 admits replenisher to the conduit 6 via heat exchanger 8. The heating action of the auxiliary heater 10*b* is adjustable in dependency on the temperature of replenisher which is supplied by the metering device 5 as well as on the quantity of replenisher which the device 5 admits into the heat exchanger 8. Such quantity depends on the size of the vessel 1 and on the average quantity of liquid which is circulated by the pump 4 per unit of time. The line 15*b* denotes schematically the connection which transmits signals denoting the quantity of admitted replenisher, and the line 15*c* denotes schematically the connection between a thermometer 15*d* in the conduit 6 and the control unit 15. The control unit 15 adjusts the auxiliary heater 10*b* (via connection 15*a*) in dependency on variations of the rate of admission and/or temperature of replenisher. Of course, the developing machine can be simplified by utilizing a non-adjustable heater 10*b* whose output remains constant and is selected in advance in dependency on the average replenisher requirements of the machine.

The operation:

The pump 4 is on and draws developing solution from the tanks 1a–1c via outlets 2a–2c, conduit 3 and tee 7. If the metering device 5 admits replenisher to the heat exchanger 8, the tee 7 also receives preheated replenisher from the conduit 6. The temperature of replenisher in the conduit 6 normally deviates from the temperature of solution in the conduit 3, i.e., the mixture of these liquids in the conduit 9 has a temperature which deviates from that of liquid in the conduit 3 and/or conduit 6. Such mixture flows through the receptacle of the heating device 10, conduit 11, filter 12, inlets 13a–13c and into the upper portions of the tanks 1a–1c.

The thermometer 14 monitors the temperature of the mixture in the conduit 11 and transmits signals to the corresponding input of the control unit 15. The auxiliary heater 10b is on whenever the metering device 5 admits replenisher to the heat exchanger 8. The control unit 15 actuates the primarY heater 10a via connection 15a whenever the intensity of signals from the thermometer 14 decreases below the optimum value, and the heater 10a remains on as long as the intensity of such signals is less than the preselected optimum value. The aforementioned first delay may equal or approximate 15 seconds, and the second delay may equal or approximate 20 seconds. The first delay is the length of interval which elapses between the transmission of a signal whose intensity is indicative of the need of starting the primary heater 10a and actual starting of the primary heater. The second delay is the interval which elapses between the transmission of a signal which is indicative of the need to arrest the primary heater 10a and actual deactivation of the primary heater. As mentioned above, such delays can be produced by suitable thermorelay or thermorelays of the control unit 15.

The invention will be further explained with reference to FIGS. 2a to 2d. In each of these Figures, the time $t$ is measured along the abscissa and the temperature $\theta$ is measured along the ordinate. In order to insure satisfactory development of photographic films or photographic paper, the deviations of bath temperature from an optimum temperature should remain within $\pm$ 0.3° C. Moreover, one must determine the optimum bath temperature and the apparatus should reduce to a minimum the frequency of deviations of actual temperature from rated temperature.

Figure 2A:
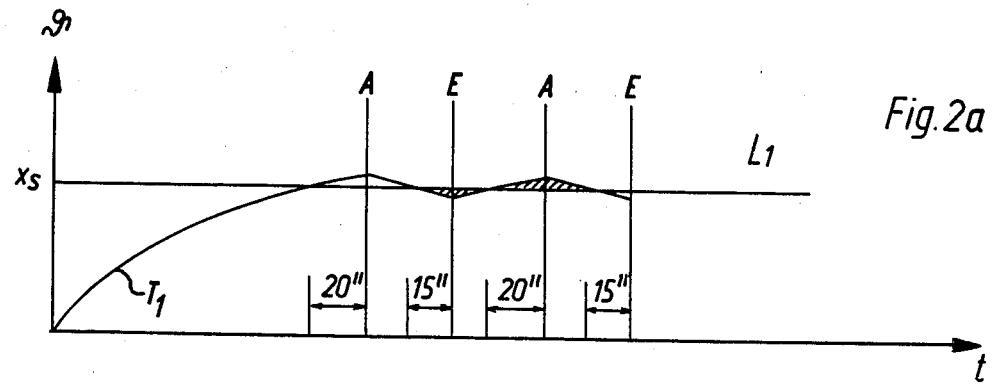
FIG. 2*a* is a diagram wherein the curve represents variations of the temperature of developing solution in the absence of admission of replenisher and at a relatively low heat energy output of the primary heater.
Figure 2B:
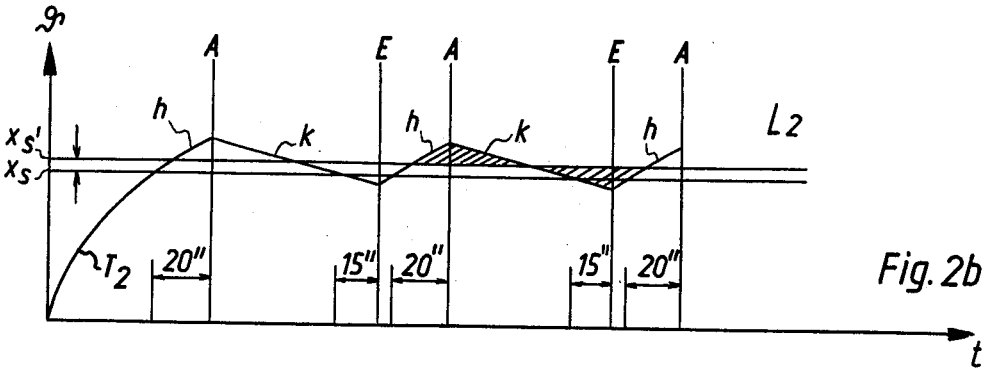
FIG. 2*b* is a similar diagram wherein the curve represents variations of the temperature of developing solution when the heat energy output of the primary heater is increased.

The curve $T_1$ of FIG. 2a denotes variations in the temperature of a bath which does not receive any replenisher. Therefore, the primary heater 10a of the heating device must have an average output $L_1$ which suffices to insure that the temperature of the bath remains substantially constant in spite of changes in the quantity of liquid and/or temperature losses due to radiation, etc. By appropriate selection of the output $L_1$ (and in the absence of an interference or distortion factor, namely the admission of replenisher), the temperature curve $T_1$ deviates only slightly from an optimum or rated value (represented by the line $x_s$). When the temperature of the liquid exceeds or drops below the rated or desired value $x_s$, the control unit 15 arrests the primary heater 10a (with a 20-second delay) or starts the primary heater (with a 15-second delay).

If the output of the primary heater 10a is higher (see FIG. 2b wherein the output $L_2$ is assumed to equal $2L_1$), the slopes of the sections of the temperature curve $T_2$ are more pronounced. The sections $h$ represent the intervals during which the temperature of the solution rises, and the sections $k$ represent intervals during which the temperature decreases. The slope of each section $h$ is more pronounced than that of the sections $k$, i.e., the rated value (represented by the line $x_s'$) rise above $x_s$. In other words, the average temperature of the solution increases by the difference between $x_s'$ and $x_s$. This is undesirable and, therefore, the heating action should be selected in such a way that the slope of sections $h$ equals the slope of sections $k$.

In actual practice, developing machines invariably (or normally) include means for supplying replenisher so that the activity of developing solution remains constant or nearly constant. Thus, in heating the solution, it is necessary to take into consideration the aforementioned interference factor which is attributable to admission of replenisher by way of the metering device 5. The interference factor is not a constant because its value varies in dependency on the quantity of exposed material which is conveyed through the vessel 1 and on the quantity and/or temperature of admitted replenisher. A curve representing changes or fluctuations of the interference factor can exhibit substantially horizontal portions (when the replenisher is admitted at a constant rate) and maxima or peaks (in response to each admission of replenisher if the latter is fed in batches rather than continuously). On the other hand, the heating action of the device 10 must be selected with a view to insure adequate heating of the mixture when the interference factor reaches a maximum value (i.e., when the relatively cool replenisher is likely to effect a maximum reduction of temperature of the solution flowing into the pump 4).

Figure 2C:
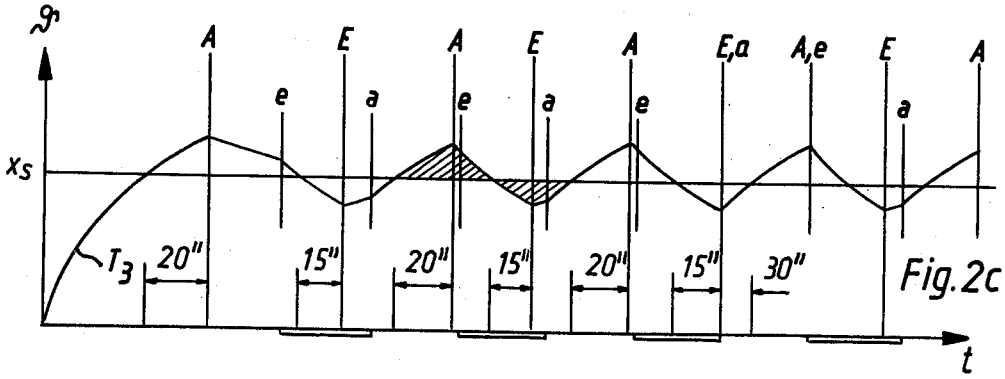
FIG. 2*c* is a diagram wherein the curve represents variations of the temperature of developing solution when the circulating solution receives replenisher at regular intervals and the temperature of the solution is regulated solely by starting or arresting the primary heater.

If one assumes that the developing machine processes an average quantity of exposed photosensitive material, and if one further assumes that the replenisher is admitted at regular intervals and in equal quantities, the curve representing the temperature of liquid in the conduit 11 corresponds to the curve $T_3$ of FIG. 2c. Thus, the heating action can be regulated in such a way that the slope of those sections of the curve $T_3$ which represent the rising temperature of the liquid in conduit 11 equals the slope of those sections of the curve $T_3$ which represent a reduction of temperature in the conduit 11. However, and as mentioned above, it is assumed that the machine processes an average quantity of exposed photographic material as well as that the replenisher is added at regular intervals, for identical periods of time and in identical quantities. The average temperature of the bath (see the rated value curve $x_s$) is satisfactory; however, the upward and downward deviations of the curve $T_3$ from the rated value are quite frequent and rather pronounced. This causes extensive wear upon the component parts of the temperature regulating means.

Figure 2D:
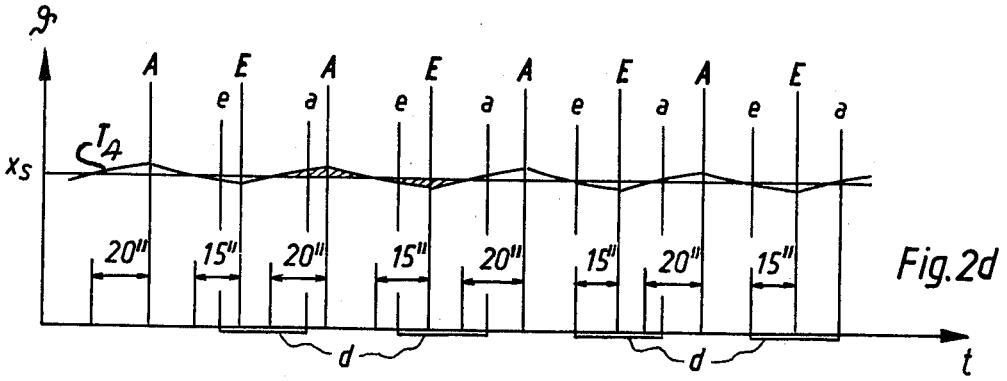
FIG. 2*d* is a diagram wherein the curve represents variations of the temperature of developing solution when the heating device comprises a primary and a secondary heater and the latter is in operation during each interval of admission of replenisher.

The regulating action is much more satisfactory (see the temperature curve $T_4$ of FIG. 2d) if the variations of the aforediscussed interference factor are reduced. This is achieved by the provision of auxiliary heater 10b which reduces the influence of admitted replenisher upon the temperature of the circulating developing solution. For example, if the replenisher is added at the rate of 2 liters per minute, if the desired or optimum temperature of the bath is 35° C., and if the temperature of replenisher in the metering device 5 is 18° C., the numerical value of the interference factor is 1,800cal/h. In other words, the heating action must be increased by approximately 2kw. However, if the auxiliary heater 10b heats the liquid in the receptacle of the heating device 10 independently of the primary heater 10a (which latter can be designed to furnish the average output L1 shown in FIG. 1), and the heating action of the auxiliary heater 10b equals or approximates 2kw, the value of the interference factor is reduced to a small fraction of 1,800kcal/h, namely to approximately 80kcal/h. This insures that the slope of upwardly inclined sections of the curve T4 equals the slope of the downwardly inclined sections, irrespective of whether or not the conduit 6 admits replenisher. FIG. 2d shows that, when the temperature of liquid in the conduit 11 rises above or drops below the rated value $x_s$, the primary heater 10a is respectively arrested with the delay of 20 seconds or started with the delay of 15 seconds. The intervals during which the replenisher is added are indicated at *d*, the start of each admission of replenisher is shown at *e* and the timing of termination of each admission of replenisher is indicated at *a*. The lines E represent the timing of starting of the primary heater 10a, and the lines A denote the timing of deactivation of the primary heater 10a. The length of each interval *d* is assumed to equal 30 seconds, and the length of each interval between two successive intervals of admission of replenisher also equals 30 seconds. The start of admission of replenisher coincides with starting of the auxiliary heater 10b, and the latter is deactivated simultaneously with termination of admission of replenisher into the tee 7. It will be noted that the curve $T_4$ approximates the rated value $x_s$ much more closely than any of the curves $T_1$, $T_2$ and $T_3$. In fact, the curve $T_4$ nearly coincides with the line representing the rated value $x_s$.

An important advantage of the improved machine is that the admission of replenisher does not result in appreciable deviations of bath temperature from a desired optimum temperature. Moreover, the heat energy requirements of the machine are surprisingly low which is desirable and advantageous for reasons which will be readily appreciated by referring to the preceding description of FIGS. 2a and 2b. By the simple expedient of employing a heating device which includes a primary heater and a secondary or auxiliary heater, and by operating the secondary heater during each interval of admission of replenisher, the adverse influence of replenisher upon the temperature of the bath can be eliminated or reduced to a negligible value. This will be readily understood by comparing the curves $T_1$ and $T_4$.

Without further analysis, the foregoing will so fully reveal the gist of the present invention that others can, by applying current knowledge, readily adapt it for various applications without omitting features that, from the standpoint of prior art, fairly constitute essential characteristics of the generic and the specific aspects of my contribution to the art and, therefore, such adaptations should and are intended to be comprehended within the meaning and range of equivalence of the appended claims.

What is claimed is:

1. In a developing machine for exposed photosensitive material, the combination of a vessel containing a supply of a first liquid and having at least one inlet and at least one outlet; first conduit means connecting said inlet with said outlet; pump means installed in said conduit means to circulate the first liquid through said conduit means from said outlet to said inlet; a heating device installed in said conduit means intermediate said pump means and said inlet, said device including a primary heater and an auxiliary heater; second conduit means communicating with said first conduit means upstream of said heating device; means for admitting to said second conduit means a second liquid at certain intervals so that said second liquid is admixed to said first liquid; and control means including means for actuating said auxiliary heater during said intervals.

2. The combination of claim 1, wherein said control means comprises means for monitoring the temperature of the mixture of said liquids downstream of said heating device and means for respectively activating and deactivating said primary heater when the temperature of said mixture respectively drops below and rises above a predetermined value.

3. The combination of claim 2, wherein said control means further comprises means for activating said primary heater with a first delay following the detection of a drop of temperature below said value and for deactivating said primary heater with a second delay following the detection of a rise of temperature above said value.

4. The combination of claim 1, wherein the temperature of said second liquid deviates from the temperature of the first liquid at said outlet and said auxiliary heater is arranged to furnish a heating action which suffices to heat a quantity of liquid corresponding to the average quantity of admitted second liquid to the temperature of said first liquid.

5. The combination of claim 1, wherein said actuating means includes means for automatically starting said auxiliary heater simultaneously with the start of admission of second liquid and for automatically arresting said auxiliary heater simultaneously with termination of admission of said second liquid.

6. The combination of claim 1, further comprising means for preheating said second liquid prior to admission into said first conduit means.

7. The combination of claim 1, wherein said auxiliary heater is adjustable and said control means includes means for adjusting said auxiliary heater as a function of variations in the quantity of admitted second liquid.

8. The combination of claim 1, wherein said auxiliary heater is adjustable and said conTrol means includes means for adjusting said auxiliary heater as a function of changes in temperature of said second liquid.

9. The combination of claim 1, wherein said first liquid is a developer and said second liquid is a replenisher, said first and second conduit means being in communication upstream of said pump means and said inlet being disposed at a level above said outlet.

10. The combination of claim 1, wherein each of said heaters is an electric heater.

* * * * *